US008651291B1

(12) United States Patent
Prather

(10) Patent No.: US 8,651,291 B1
(45) Date of Patent: Feb. 18, 2014

(54) JEWELRY STORAGE AND ORGANIZATION SYSTEM

(76) Inventor: Jannie M. Prather, Kingsville, TX (US)

( * ) Notice: Subject to any disclaimer, the term of this patent is extended or adjusted under 35 U.S.C. 154(b) by 43 days.

(21) Appl. No.: 13/479,548

(22) Filed: May 24, 2012

(51) Int. Cl.
*A47F 7/02* (2006.01)

(52) U.S. Cl.
USPC ..... 211/85.2; 211/85.3; 211/113

(58) Field of Classification Search
USPC ..... 211/85.2, 123, 124, 89.01, 119, 113, 211/85.3, 119.004, 119.009; 206/6.1; 223/85, DIG. 1, DIG. 2, DIG. 4, 88, 92, 223/95, 97; D6/315, 317, 328, 309, 546, D6/326; D11/17, 22, 86; 24/369, 716, 24/592.1, 601.3
See application file for complete search history.

(56) References Cited

U.S. PATENT DOCUMENTS

| | | | | | |
|---|---|---|---|---|---|
| 254,451 | A | * | 3/1882 | Bisbee | 223/88 |
| 1,286,595 | A | * | 12/1918 | Jacobs | 223/85 |
| 1,982,166 | A | * | 11/1934 | Hultquist | 223/85 |
| D167,836 | S | * | 9/1952 | Kandarian | D6/318 |
| D175,456 | S | * | 8/1955 | Behlefeldt | D6/327 |
| 2,786,615 | A | * | 3/1957 | Saibene | 223/25 |
| 3,029,990 | A | * | 4/1962 | Roberts et al. | 223/88 |
| 3,138,259 | A | | 6/1964 | Sitt | |
| 3,339,745 | A | * | 9/1967 | Sugerman | 211/85.2 |
| D229,003 | S | * | 11/1973 | Wahl | D6/317 |
| 4,573,585 | A | * | 3/1986 | Frei | 211/85.2 |
| 4,778,088 | A | * | 10/1988 | Miller | 223/91 |
| 4,966,287 | A | * | 10/1990 | Snyder | 211/85.2 |
| D319,738 | S | * | 9/1991 | Hasslocher | D6/316 |
| D323,755 | S | | 2/1992 | Harney | |
| D334,668 | S | * | 4/1993 | Miyahara | D6/317 |
| 5,240,120 | A | * | 8/1993 | McDonough | 211/85.2 |
| 5,363,953 | A | | 11/1994 | Carter | |
| 5,509,588 | A | * | 4/1996 | Kimball | 223/98 |
| D438,746 | S | | 3/2001 | Barker et al. | |
| 6,196,396 | B1 | * | 3/2001 | Bennett | 211/85.3 |
| 6,334,559 | B1 | | 1/2002 | Armaly | |
| D471,725 | S | * | 3/2003 | Bodine | D6/328 |
| 6,776,463 | B2 | * | 8/2004 | Simon et al. | 312/204 |
| 7,059,469 | B2 | | 6/2006 | Simon et al. | |
| D554,377 | S | * | 11/2007 | Therrio et al. | D6/315 |
| D554,982 | S | | 11/2007 | Wenck | |
| 7,377,409 | B1 | * | 5/2008 | Brown | 223/88 |
| 7,500,586 | B2 | | 3/2009 | Oliveira-Martinez | |
| 8,070,025 | B1 | * | 12/2011 | Nelson | 223/88 |
| 2002/0148082 | A1 | * | 10/2002 | Wang | 24/369 |
| 2009/0057166 | A1 | | 3/2009 | Nelson | |

OTHER PUBLICATIONS www.mileskimball.com; Hanging Jewelry Organizer; internet; as of Feb. 2, 2012.

* cited by examiner

*Primary Examiner* — Jennifer E Novosad

(57) ABSTRACT

A jewelry storage and organization system for easily grouping matched pieces and aiding quick retrieval of one or more pieces has a hanging rod for attaching to a planar vertical surface using a plurality of hanging rod attachment brackets. The system has a generally planar oval loop member with an internal jewelry attachment member. The loop member is located onto the hanging rod and can slide. Jewelry can be located on the loop member via the internal jewelry attachment member or the loop bottom.

5 Claims, 4 Drawing Sheets

JEWELRY STORAGE AND ORGANIZATION SYSTEM

BACKGROUND OF THE INVENTION

Jewelry has been around arguably since the beginning of human civilization. From precious and semi-precious stones to bone and metals, ornamentation of all types worn on humans has been predominant throughout history. Because of the prevalence of jewelry, a need arose for a way to store jewelry when it is not being worn. Rings, necklaces, bracelets and other forms of jewelry have been stored in chests, cabinets, drawers as well as being hung on hooks or knobs. Often jewelry such as necklaces can become entangled when stored using traditional methods. Other times, jewelry that is part of a matched set can be difficult to find using traditional storage methods. The present invention teaches a jewelry storage and organization system for easily grouping matched pieces and aiding quick retrieval of one or more pieces.

SUMMARY

The present invention features a jewelry storage and organization system for easily grouping matched pieces and aiding quick retrieval of one or more pieces. In some embodiments, the system comprises a hanging rod for attaching to a planar vertical surface using a plurality of hanging rod attachment brackets.

In some embodiments, the system comprises a generally planar oval loop member. In some embodiments, the loop member further comprises an internal jewelry attachment member. In some embodiments, the loop member is located on and slides on the hanging rod. In some embodiments, jewelry can be located on the loop member via the internal jewelry attachment member or the loop bottom.

In some embodiments, the jewelry storage and organization system is for easily grouping matched pieces and aiding quick retrieval of one or more pieces.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Following is a list of elements corresponding to a particular element referred to herein:

100 Jewelry storage and organization system
110 Jewelry

Figure 1:
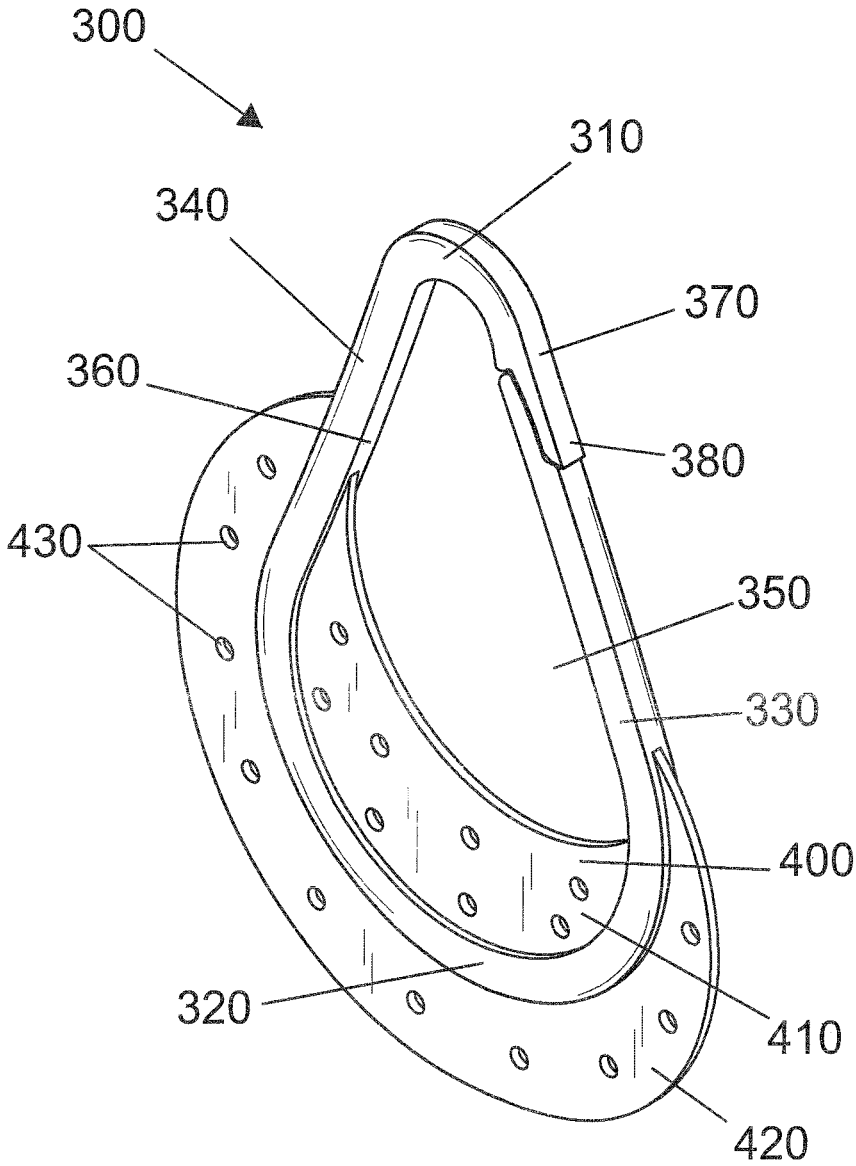
FIG. 1 is a perspective view of the loop member of the present invention.
Figure 2:
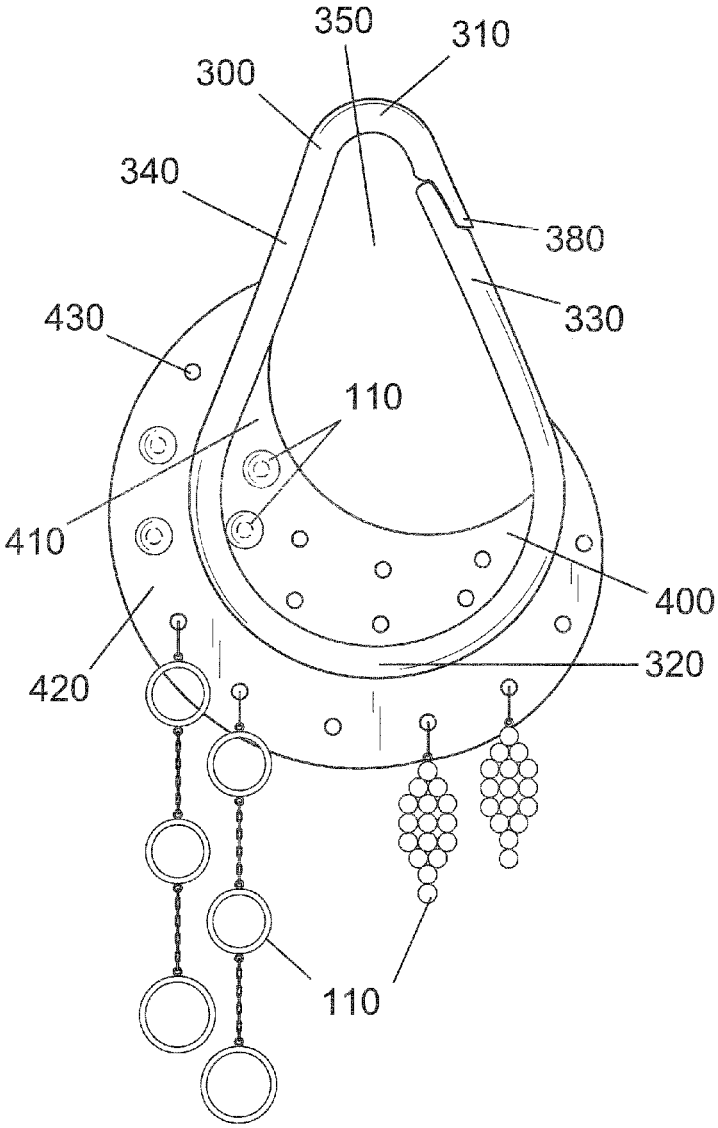
FIG. 2 is a front view of the loop member of the present invention.
Figure 3:
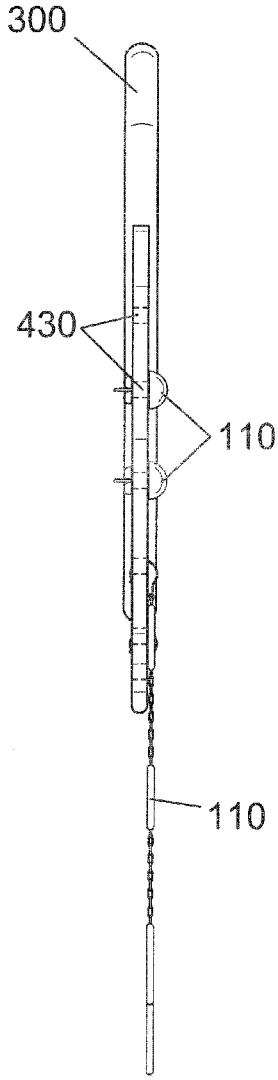
FIG. 3 is a side view of the loop member of the present invention.
Figure 4:
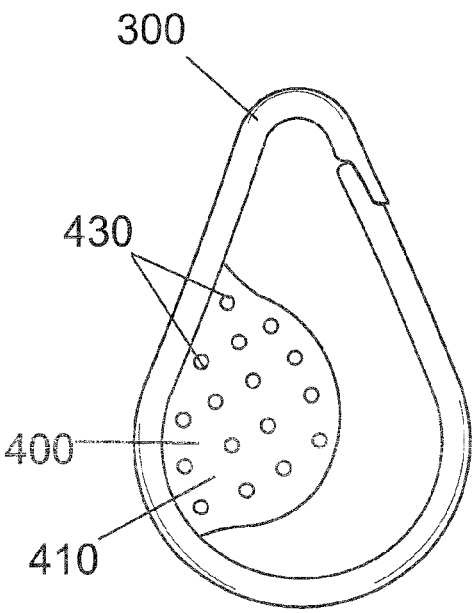
FIG. 4 is a front view of an alternate embodiment of the loop member of the present invention.
Figure 5:
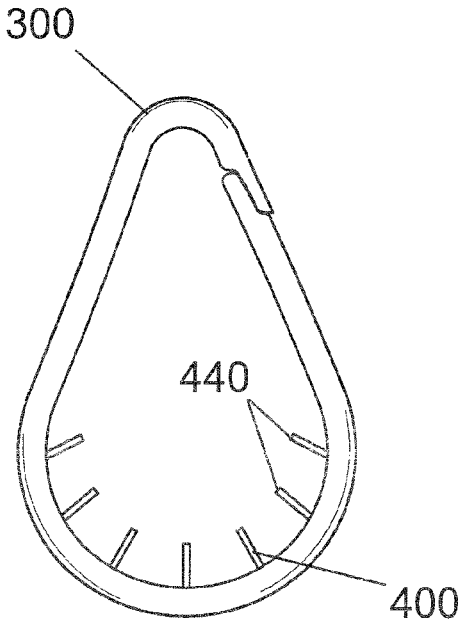
FIG. 5 is a front view of an alternate embodiment of the loop member of the present invention.
Figure 6:
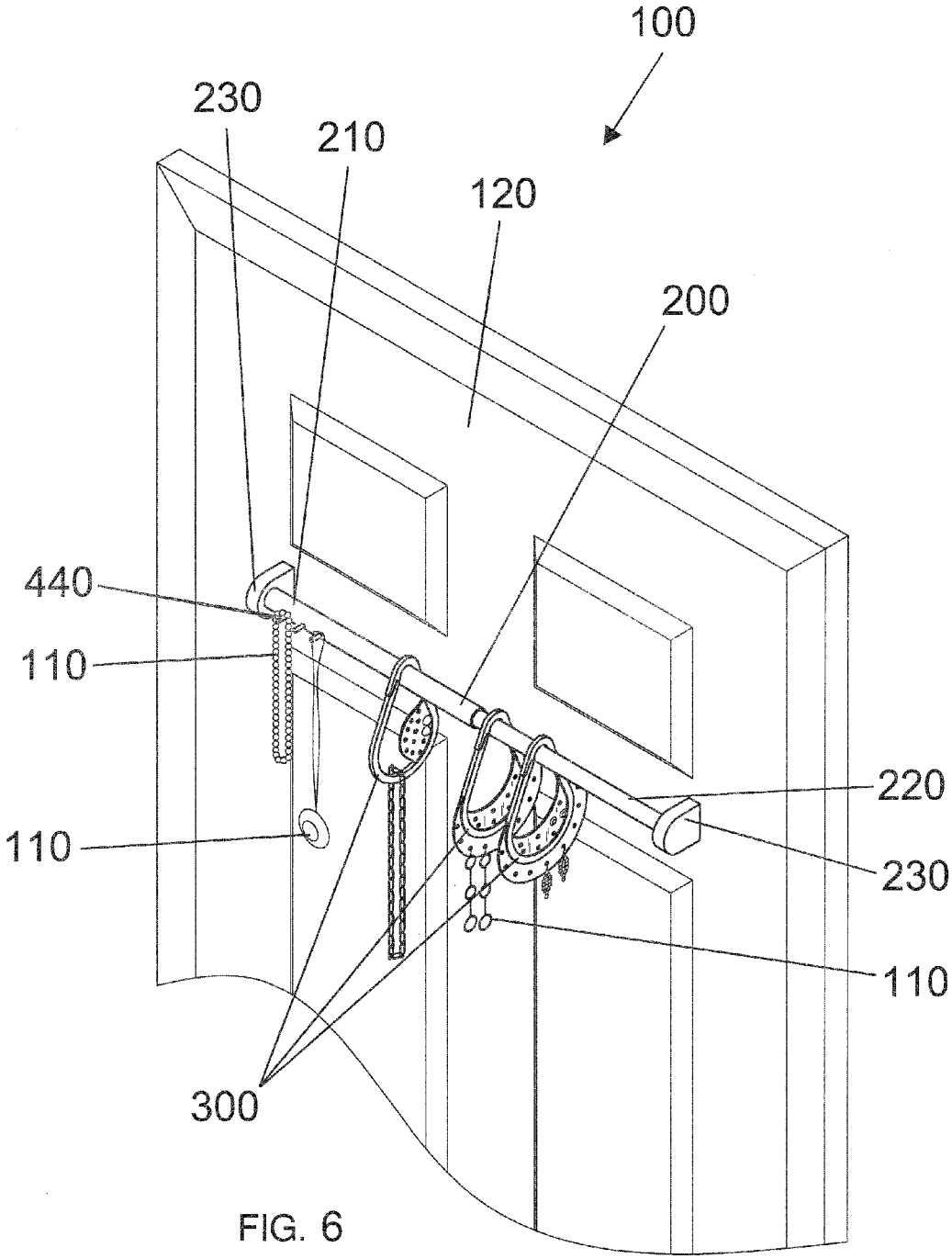
FIG. 6 is a perspective view of the present invention.

120 Vertical surface
200 Hanging rod
210 Rod first end
220 Rod second end
230 Rod attachment bracket
300 Loop member
310 Loop top
320 Loop bottom
330 First loop side
340 Second loop side
350 Loop open internal area
360 Loop member interior surface
370 Loop member exterior surface
380 Clip
400 Jewelry attachment member
410 Internal web member
420 External fin member
430 Aperture
440 Projection Referring now to FIG. 1-6, the present invention features a jewelry storage and organization system (100) for easily grouping matched jewelry (110) pieces and aiding quick retrieval of one or more jewelry (110) pieces. In some embodiments, the system (100) comprises a generally horizontally positioned hanging rod (200) having a rod first end (210) and a rod second end (220) for attaching to a planar vertical surface (120) via a plurality of rod attachment brackets (230). In some embodiments, the planar vertical surface (120) is a closet door or a wall. In some embodiments, a projection (440) is horizontally located on the hanging rod (200) for hanging jewelry (110).

In some embodiments, the system (100) comprises a generally planar oval loop member (300) having a generally arc-shaped loop top (310), a generally arc-shaped loop bottom (320), a first loop side (330), and a second loop side (340). In some embodiments, the loop member (300) comprises a loop open internal area (350) located between the loop top (310), the loop bottom (320), the first loop side (330), and the second loop side (340). In some embodiments, the loop member (300) comprises a general shape of two offset eccentric circles tangentially connected by two outer tangents having the loop open internal area (350) located within.

In some embodiments, the loop top (310) comprises a smaller radius than the loop bottom (320). In some embodiments, the loop member (300) is generally continuous. In some embodiments, the loop member (300) is constructed from unitary construction.

In some embodiments, the loop member (300) comprises an internal jewelry attachment member (400) located on a loop member interior surface (360). In some embodiments, the first loop side (330) comprises a clip (380). In some embodiments, in a first open position, the loop member (300) can spread apart and be inserted over or removed from the hanging rod (200). In some embodiments, in a second closed position, the loop member (300) cannot be spread apart and inserted over or removed from the hanging rod (200).

In some embodiments, the loop member (300) is located onto the hanging rod (200) in a manner to where it can slide. In some embodiments, the loop member (300) hangs from the hanging rod (200) via the loop top (310). In some embodiments, jewelry (110) can be located on the loop member (300) via the internal jewelry attachment member (400) or the loop bottom (320).

In some embodiments, the jewelry storage and organization system (100) is for easily grouping matched jewelry (110) pieces and aiding quick retrieval of one or more jewelry (110) pieces.

In some embodiments, the loop member (300) comprises an internal web member (410). In some embodiments, the internal jewelry attachment member (400) comprises an internal web member (410). In some embodiments, the internal web member (410) is located on the loop member interior surface (360) and lies on the same plane as the loop member (300). In some embodiments, the internal web member (410) projects toward and into the loop open internal area (350). In some embodiments, the internal web member (410) comprises an aperture (430) located through a cross-section thereof for mounting jewelry (110).

In some embodiments, the loop member (300) further comprises an external fin member (420). In some embodiments, the external fin member (420) is located on a loop member exterior surface (370) and lies on the same plane as the loop member (300). In some embodiments, the external fin member (420) projects out and away from the loop member (300). In some embodiments, the external web member comprises an aperture (430) located through a cross-section thereof for mounting jewelry (110).

In some embodiments, the loop member (300) comprises a projection (440). In some embodiments, the internal jewelry attachment member (400) comprises a projection (440). In some embodiments, the projection (440) is located on the loop member interior surface (360). In some embodiments, the projection (440) projects toward the loop open internal area (350) for mounting jewelry (110).

In some embodiments, the loop member (300) further comprises an internal web member (410). In some embodiments, the internal jewelry attachment member (400) comprises an internal web member (410). In some embodiments, the internal web member (410) is located only on the loop member interior surface (360) of the second loop side (340) and lies on the same plane as the loop member (300). In some embodiments, the internal web member (410) projects toward and into the loop open internal area (350). In some embodiments, the internal web member (410) comprises an aperture (430) located through a cross-section for mounting jewelry (110).

As used herein, the term "about" refers to plus or minus 10% of the referenced number. For example, an embodiment wherein the loop member is about 10 inches in diameter includes a loop member that is between 9 and 11 inches in length.

The disclosures of the following U.S. Patents are incorporated in their entirety by reference herein: U.S. Pat. No. D 554,982; U.S. Pat. No. D 438,746; U.S. Pat. No. D 323,755; U.S. Pat. Pub. No. 2009/0057166; U.S. Pat. No. 7,500,586; U.S. Pat. No. 7,059,469; U.S. Pat. No. 6,334,559; U.S. Pat. No. 5,363,953; U.S. Pat. No. 4,966,287; U.S. Pat. No. 3,138,259.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A jewelry storage and organization system (100) for easily grouping matched jewelry (110) pieces and aiding quick retrieval of one or more jewelry (110) pieces, wherein said system (100) comprises:

(a) a generally horizontal hanging rod (200) having a rod first end (210) and a rod second end (220) for attaching to a planar vertical surface (120) via a plurality of rod attachment brackets (230), wherein a projection (440) is horizontally disposed on the hanging rod (200) for hanging jewelry (110); and (b) a generally planar oval loop member (300) having a generally arc-shaped loop top (310), a generally arc-shaped loop bottom (320), a first loop side (330), and a second loop side (340), wherein the loop member (300) comprises a loop open internal area (350) disposed between the loop top (310), the loop bottom (320), the first loop side (330), and the second loop side (340), wherein the loop member (300) comprises a general shape of two offset eccentric circles tangentially connected by two outer tangents having the loop open internal area (350) disposed within, wherein the loop top (310) comprises a smaller radius than the loop bottom (320), wherein the loop member (300) is generally continuous, wherein the loop member (300) is constructed from unitary construction, wherein the loop member (300) further comprises an internal jewelry attachment member (400) disposed on a loop member interior surface (360), wherein the first loop side (330) comprises a clip (380), wherein in a first open position, the loop member (300) can spread apart and be inserted over or removed from the hanging rod (200), wherein in a second closed position, the loop member (300) cannot be spread apart and inserted over or removed from the hanging rod (200), wherein the loop member (300) is slidably disposed onto the hanging rod (200), wherein the loop member (300) hangs from the hanging rod (200) via the loop top (310), wherein jewelry (110) can be disposed on the loop member (300) via the internal jewelry attachment member (400) or the loop bottom (320), wherein the jewelry storage and organization system (100) is for easily grouping matched jewelry (110) pieces and aiding quick retrieval of one or more jewelry (110) pieces.

2. The system (100) of claim 1, wherein the internal jewelry attachment member (400) comprises an internal web member (410), wherein the internal web member (410) is planarly disposed on the loop member interior surface (360), wherein the internal web member (410) projects toward and into the loop open internal area (350), wherein the internal web member (410) comprises an aperture (430) disposed through a cross-section thereof for mounting jewelry (110).

3. The system (100) of claim 1, wherein the loop member (300) further comprises an external fin member (420), wherein the external fin member (420) is planarly disposed on a loop member exterior surface (370), wherein the external fin member (420) projects out and away from the loop member (300), wherein the external web member comprises an aperture (430) disposed through a cross-section thereof for mounting jewelry (110).

4. The system (100) of claim 1, wherein the internal jewelry attachment member (400) comprises the projection (440), wherein the projection (440) is disposed on the loop member interior surface (360), wherein the projection (440) projects toward the loop open internal area (350) for mounting jewelry (110).

5. The system (100) of claim 1, wherein the internal jewelry attachment member (400) comprises an internal web member (410), wherein the internal web member (410) is planarly disposed only on the loop member interior surface (360) of the second loop side (340), wherein the internal web member (410) projects toward and into the loop open internal area (350), wherein the internal web member (410) comprises an aperture (430) disposed through a cross-section for mounting jewelry (110).

* * * * *